US008369725B2

(12) United States Patent
Ohshima et al.

(10) Patent No.: US 8,369,725 B2
(45) Date of Patent: Feb. 5, 2013

(54) IMAGE FORMING APPARATUS AND METHOD OF CORRECTING IMAGE CONCENTRATION

(75) Inventors: Tomohiro Ohshima, Ikeda (JP); Tatsuya Miyadera, Ikeda (JP); Yoshinori Shirasaki, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 337 days.

(21) Appl. No.: 12/870,207

(22) Filed: Aug. 27, 2010

(65) Prior Publication Data

US 2011/0052232 A1 Mar. 3, 2011

(30) Foreign Application Priority Data

Aug. 27, 2009 (JP) ..... 2009-196876
Aug. 11, 2010 (JP) ..... 2010-180556

(51) Int. Cl.
*G03G 15/00* (2006.01)

(52) U.S. Cl. ..... 399/49

(58) Field of Classification Search ..... 399/49, 399/58, 60, 72
See application file for complete search history.

(56) References Cited

U.S. PATENT DOCUMENTS

| | | | | |
|---|---|---|---|---|
| 7,715,769 | B2 | 5/2010 | Miyadera | |
| 8,045,873 | B2 * | 10/2011 | Kobayashi | 399/49 |
| 8,249,477 | B2 * | 8/2012 | Masuda et al. | 399/60 |
| 2008/0069602 | A1 | 3/2008 | Miyadera | |
| 2008/0170868 | A1 | 7/2008 | Miyadera | |
| 2008/0212986 | A1 | 9/2008 | Miyadera | |
| 2009/0074476 | A1 | 3/2009 | Miyadera | |
| 2009/0190940 | A1 | 7/2009 | Miyadera | |
| 2009/0196636 | A1 | 8/2009 | Miyadera | |
| 2010/0119273 | A1 | 5/2010 | Komai et al. | |

FOREIGN PATENT DOCUMENTS

| | | |
|---|---|---|
| JP | 2006-337552 | 12/2006 |
| JP | 2007-121907 | 5/2007 |
| JP | 2007-279523 | 10/2007 |
| JP | 2008-83252 | 4/2008 |

OTHER PUBLICATIONS

U.S. Appl. No. 12/723,908, filed Mar. 15, 2010, Tatsuya Miyadera et al.

* cited by examiner

*Primary Examiner* — Walter L Lindsay, Jr.
*Assistant Examiner* — Frederick Wenderoth
(74) *Attorney, Agent, or Firm* — Oblon, Spivak, McClelland, Maier & Neustadt, L.L.P.

(57) ABSTRACT

An image forming apparatus includes an image forming unit, a first detector including a first light emitting device, a first mixed-light receiving device and a first diffuse reflection light receiving device, a second detector including a second light emitting device and a second mixed-light receiving device, and a concentration correction unit. The first mixed-light receiving device detects a mixed light including regular and diffuse reflection light reflected from a transport member. The first diffuse reflection light receiving device detects the diffuse reflection light. The second mixed-light receiving device detects the mixed light. The concentration correction unit conducts concentration correction using detection results of the first and second detectors. A first correction pattern reflecting the regular and diffuse reflection light and detectable by the first detector and a second correction pattern reflecting only the regular reflection light and detectable by the second detector are formed different positions on the transport member.

7 Claims, 12 Drawing Sheets

IMAGE FORMING APPARATUS AND METHOD OF CORRECTING IMAGE CONCENTRATION

CROSS-REFERENCE TO RELATED APPLICATION

This application claims priority to Japanese Patent Application Nos. 2009-196876, filed on Aug. 27, 2009 and 2010-180556, filed on Aug. 11, 2010 in the Japan Patent Office, which are hereby incorporated by references herein in their entirety.

BACKGROUND OF THE INVENTION

1. Field of the Invention

The present invention relates to an image forming apparatus and a method of correcting image concentration for an image forming apparatus.

2. Description of the Background Art

Generally, image forming apparatuses may need adjustment of image density (or concentration) at a given timing. For example, in an image forming apparatus of JP-2008-83252-A, a control method to reduce time required for re-adjustment of image density during an image forming operation is disclosed. When the re-adjustment timing of image density comes during the image forming operation, patches are formed and the concentration of patches are detected to determine whether re-adjustment of image density is required based on the extent of difference between the detected patch concentration and a target.

Further, for example, JP-2007-279523-A discloses an image forming apparatus that can suppress the downtime occurrence and can efficiently conduct processes such as an image forming operation. In JP-2007-279523-A, the image forming apparatus such as a copier includes a photoconductor drum, which forms toner images to be transferred to recording sheets or patch images to be read by a concentration sensor, and an intermediate transfer belt to transfer images from the photoconductor drum at a transfer position. The intermediate transfer belt is disposed with a position sensor facing the belt and a control unit that obtains spectrum data of the intermediate transfer belt detected by the position sensor, and sets a phase address on the intermediate transfer belt as a reference position.

In tandem type image forming apparatuses such as laser beam printers, a plurality of image forming units is used to superimpose toner images on an intermediate transfer belt to form a color image. However, the properties of the toner are affected by environmental changes, by which toner concentration when toner images are transferred to a paper may change, and thereby a stable color image cannot be obtained.

In light of such situation, a concentration correction process is conducted, in general, in which concentration correction patterns are formed for each color, a detector such as a toner mark (TM) sensor detects transferred toner concentration, and toner concentration is corrected to a target concentration.

The TM sensor may be of two types. One type of sensor has a light-receiving unit that can measure only regular reflection light. The other type of sensor has a light receiving unit that can measure both regular reflection light and diffuse reflection light. In low-end laser beam printers, the number of TM sensors that can measure both regular reflection light and diffuse reflection light is reduced to a minimum to reduce cost.

The concentration correction patterns are required to be provided under TM sensors that can measure both regular reflection light and diffuse reflection light. Further, to use uniform property for light emitting and light receiving of the TM sensor, the concentration correction patterns are usually disposed directly below a single TM sensor. In such a case, as the intermediate transfer belt rotates, the concentration correction patterns ultimately contact a given portion of a transfer roller and toner concentrates at that portion. After all the concentration correction patterns pass over the transfer roller, the roller must be cleaned to remove the toner. Further, even if the concentration is corrected once, the concentration may deviate from the target concentration due to environmental condition changes or simply over time. Therefore concentration correction may need to be conducted periodically. Even then, however, the concentration correction patterns formed on the intermediate transfer belt adhere to the transfer roller, and the transfer roller must be cleaned to remove the toner.

The transfer roller can be cleaned by applying plus and minus bias voltage alternately to the transfer roller, by which toner can be scattered to the intermediate transfer belt. Accordingly, the cleaning time becomes longer in proportion to the concentration (or level of contamination) of the most contaminated portion on the transfer roller. A printing operation cannot be conducted when the transfer roller is undergoing cleaning, which constitutes significant downtime for a user and decreases productivity.

SUMMARY

In one aspect of the preset invention, an image forming apparatus is devised. The image forming apparatus includes an image forming unit, a first detector, a second detector, and a concentration correction unit. The image forming unit develops an electrostatic latent image on an image bearing member as a toner image and transfers the toner image onto a transport member. The first detector includes a first light emitting device, a first mixed-light receiving device, and a first diffuse reflection light receiving device. The first mixed-light receiving device detects a mixed light including regular reflection light and diffuse reflection light, the regular reflection light is composed of a regular reflection light component reflected from the transport member when the first light emitting device irradiates the transport member with light, and the diffuse reflection light is composed of a diffuse reflection light component reflected from the transport member when the first light emitting device irradiates the transport member with light. The first diffuse reflection light receiving device detects the diffuse reflection light. The second detector includes a second light emitting device and a second mixed-light receiving device for detecting the mixed light. The concentration correction unit conducts concentration correction using detection results of the first detector and the second detector. The first detector and the second detector are arranged side by side in a main scanning direction of the transport member. The image forming unit develops a first correction pattern using a first color toner that reflects the regular and diffuse reflection light, and transfers the first correction pattern as a concentration correction pattern used for concentration correction by the concentration correction unit at a position on the transport member detectable by the first detector, while the image forming unit develops a second correction pattern using a second color toner that reflects only the regular reflection light, and transfers the second correction pattern as a concentration correction pattern used for concentration correction by the concentration correction unit at a position on the transport member detectable by the second detector.

In another aspect of the preset invention, a concentration correction method for an image forming apparatus is devised. The image forming apparatus includes an image forming unit, a first detector, and a second detector. The image forming unit develops an electrostatic latent image on an image bearing member as a toner image and transfers the toner image onto a transport member. The first detector includes a first light emitting device, a first mixed-light receiving device, and a first diffuse reflection light receiving device. The first mixed-light receiving device detects a mixed light including regular reflection light and diffuse reflection light, the regular reflection light is composed of a regular reflection light component reflected from the transport member when the first light emitting device irradiates the transport member with light, and the diffuse reflection light is composed of a diffuse reflection light component reflected from the transport member when the first light emitting device irradiates the transport member with light. The first diffuse reflection light receiving device detects the diffuse reflection light. The second detector includes a second light emitting device and a second mixed-light receiving device for detecting the mixed light. The method includes the steps of transferring a first correction pattern, transferring a second correction pattern, computing toner concentration, and correcting the toner concentration. The first correction pattern transferring step transfers a first correction pattern, used as a concentration correction pattern for concentration correction, developed by a first color toner that reflects the regular and diffuse reflection light at a position on the transport member detectable by the first detector. The second correction pattern transferring step transfers a second correction pattern used as a concentration correction pattern for concentration correction, developed by a second color toner that reflects only the regular reflection light at another position on the transport member detectable by the second detector arranged side by side with the first detector in a main scanning direction of the transport member. The toner concentration computing step computes toner concentration of an image formed on the transport member based on detection results of the first detector and the second detector. The toner concentration correcting step corrects the toner concentration of the image based on the computed toner concentration.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
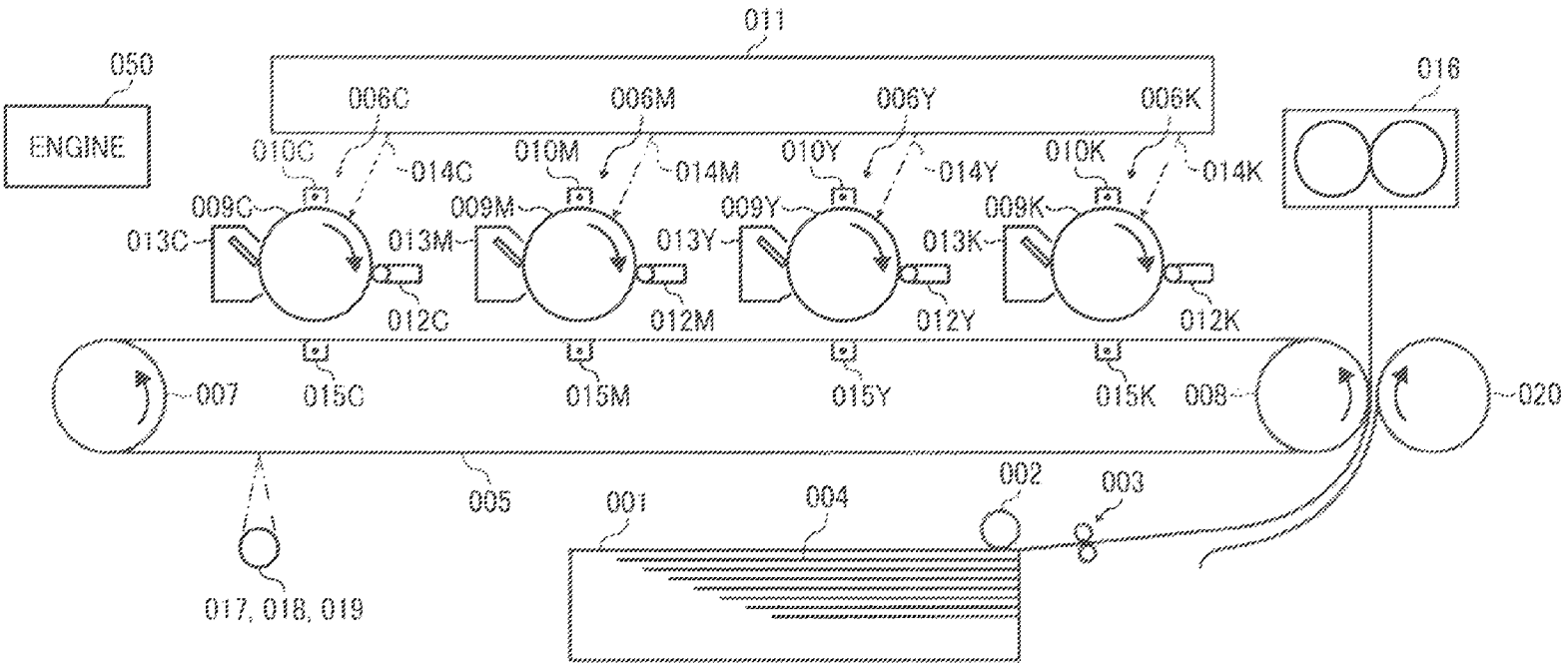
FIG. 1 shows a schematic configuration of an image forming apparatus according to a first example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming system or apparatus according to example embodiments are described.

First Example Embodiment

An image forming apparatus according to a first example embodiment includes a first detector which detects mixed light of regular and diffuse reflection light, and diffuse reflection light, and a second detector which detects mixed light of regular and diffuse reflection light, in which a concentration correction is conducted using yellow, magenta, cyan, and black toner, for example.

As shown in FIG. 1, an image forming apparatus according to a first example embodiment includes an intermediate transfer belt 005 used as a transport member and image forming units for each color disposed along the intermediate transfer belt 005, which may be called as a tandem type machine. The intermediate transfer belt 005 is used to transfer an image to a sheet 004 such as a recording sheet (e.g., paper) fed from a sheet feed tray 001 using a sheet feed roller 002 and a separation roller 003. A plurality of image forming units 006K, 006Y, 006M, and 006C (used as electrophotography processing unit) are arranged in a given order along the intermediate transfer belt 005 from an upstream of a rotation direction of the intermediate transfer belt 005. Further, the image forming unit according to a first example embodiment may configure an image forming system with a transfer unit to be explained later.

Each of the image forming units 006K, 006Y, 006M, 006C has a same internal structure except the colors of toner. The image forming unit 006K forms a black image, the image forming unit 006Y forms a yellow image, the image forming unit 006M forms a magenta image, and the image forming unit 006C forms a cyan image.

Accordingly, in the following description, the image forming unit 006K will be explained in detail because other image forming units 006Y, 006M, and 006C are same as the image forming unit 006K. Accordingly, as for components of the image forming units 006Y, 006M, and 006C, reference signs of Y, M, and C may be attached to the components in the drawings instead of K attached to the components for the image forming unit 006K, and explanation of image forming units 006Y, 006M, 006C may be omitted.

The intermediate transfer belt 005 may be an endless belt extended by a drive roller 007 and a driven roller 008, and a driving force of the drive roller 007 rotates the intermediate transfer belt 005. A driving force of drive motor, not shown, rotates the drive roller 007. Such drive motor, the drive roller 007, and the driven roller 008 move the intermediate transfer belt 005.

When an image forming operation is conducted, the sheet 004 stored in the sheet feed tray 001 is fed from an uppermost sheet in the sheet feed tray 001. When the sheet 004 reaches a position of the driven roller 008 and a transfer roller 020, an image formed on the intermediate transfer belt 005 is transferred to the sheet 004.

The image forming unit 006K may include a photoconductor drum 009K used as an image bearing member, a charger 010K, a development unit 012, a photoconductor cleaner (not shown), and a decharger 013K disposed around the photoconductor drum 009K, for example, and an exposure unit 011 is disposed over the image forming units 006K, 006Y, 006M, and 006C. The exposure unit 011 emits laser beams 014K, 014Y, 014M, and 014C, corresponding to exposure beams to form images on the image forming units 006K, 006Y, 006M, and 006C.

Figure 2:
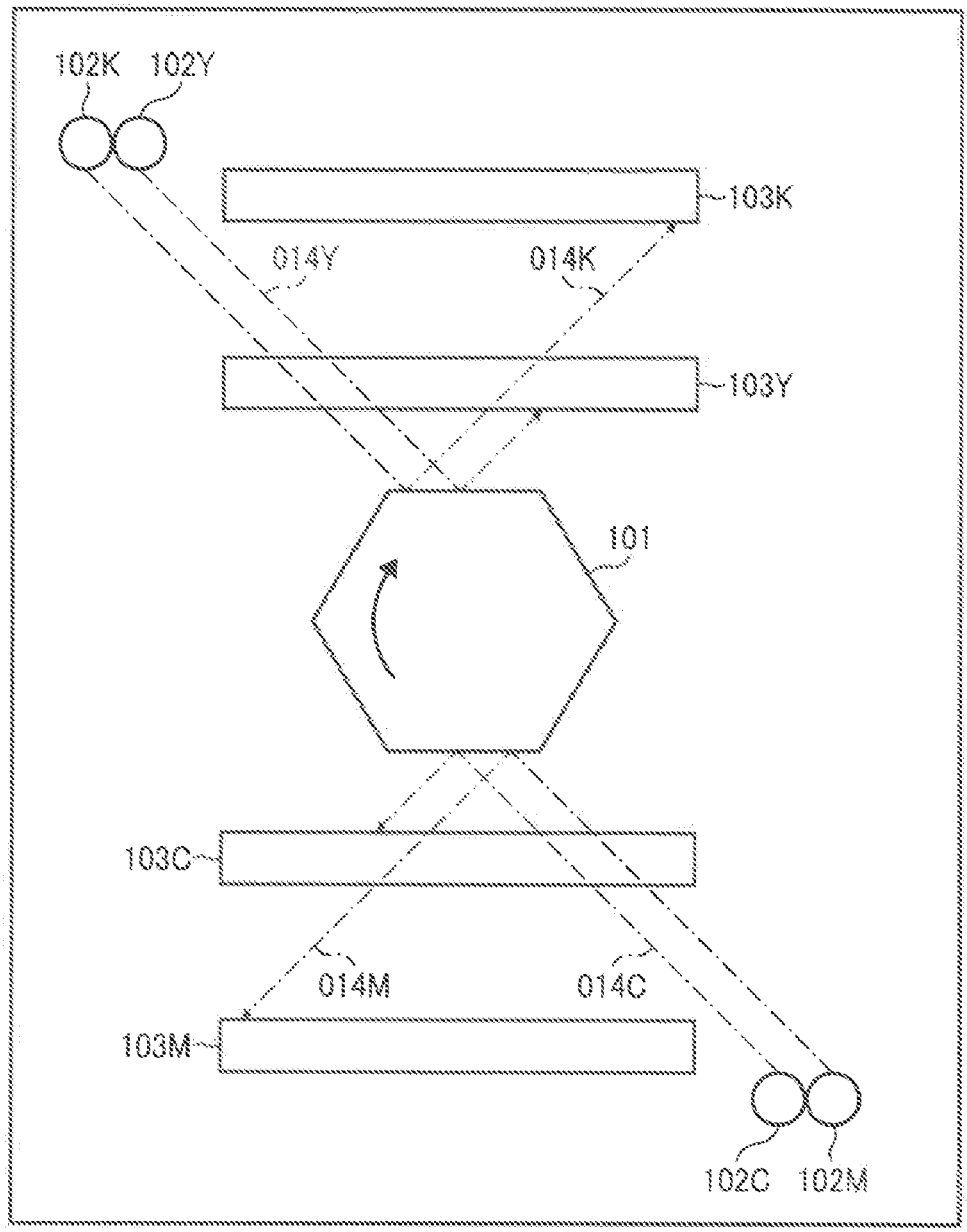
FIG. 2 shows a schematic configuration of an exposure unit of image forming apparatus according to a first example embodiment.

FIG. 2 shows an example configuration of the exposure unit 011, which includes laser diodes 102K, 102Y, 102M, and 102C used as light sources to emit the exposure beams of laser beams 014K, 014Y, 014M, and 014C for each of image colors. The emitted laser beams, reflected at a reflection mirror 101, passes optical members 103K, 103Y, 103M, and 103C to adjust a light path, and the laser beams scan surfaces of the photoconductor drums 009K, 009Y, 009M, and 009C. The reflection mirror 101 may be a hexagonal polygon mirror, and when the reflection mirror 101 rotates, one line image in a main scanning direction can be scanned using an exposure beam reflecting by one face of polygon mirror. In example embodiments, four light sources such as laser diodes and one polygon mirror are used for scanning, for example. Specifically, two exposure beams of 014K and 014Y, and two exposure beams of 014M and 014C may be reflected at two opposing faces of polygon mirror for scanning process, by which an exposure process can be conducted to different four photoconductor drums at the same time. The optical members 103 may include an f-theta lens to set a uniform speed for the reflected laser beam, and a reflection mirror for reflecting the laser beam, or the like.

When an image forming operation is conducted, an outer surface of the photoconductor drum 009K is uniformly charged by the charger 010K in a dark environment, and then the laser beam 014K for black image emitted from the exposure unit 011 exposes the photoconductor drum 009K to form an electrostatic latent image. The development unit 012 develops the electrostatic latent image as a visible image using black toner, by which a black toner image is formed on the photoconductor drum 009K.

This black toner image is transferred to the intermediate transfer belt 005 at a contact position (or transfer position) of the photoconductor drum 009K and the intermediate transfer belt 005 with an effect of a transfer unit 015K used as one unit of image forming system. After completing toner image transfer, toner remaining on the photoconductor drum 009K is removed using the photoconductor cleaner, and then the photoconductor drum 009K is decharged by the decharger 013K, by which the photoconductor drum 009K is ready for a next image forming operation.

Then, the black toner image transferred onto the intermediate transfer belt 005 is transported to a next image forming unit of the image forming unit 006Y by rotating the intermediate transfer belt 005. In the image forming unit 006Y, as similar to the image forming process in the image forming unit 006K, a yellow toner image is formed on the photoconductor drum 009Y, and the yellow toner image is superimposingly transferred onto the black toner image formed on the intermediate transfer belt 005.

The intermediate transfer belt 005 is then further rotated so that a magenta toner image formed on the photoconductor drum 009M and a cyan toner image formed on the photoconductor drum 009C are superimposingly transferred onto the black toner image and yellow toner image formed on the intermediate transfer belt 005 in a similar manner. With such processing, a full color image is formed on the intermediate transfer belt 005. When the intermediate transfer belt 005 is further rotated, the full color image is transferred onto the sheet 004 at the position between the driven roller 008 and the transfer roller 020. After fusing the image on the sheet 004 using a fusing unit 016, the sheet 004 is ejected outside of the image forming apparatus. In the image forming apparatus such as color image forming apparatus, concentration of toner image may change, which is not preferable, due to several factors such as change of image forming property of the image forming units 006K, 006Y, 006M, and 006C due to replacement of the image forming units; change of image forming property of the image forming units 006K, 006Y, 006M, and 006C due to temperature increase of the image forming units 006K, 006Y, 006M, and 006C; change of image forming property of the photoconductor drums 009K, 009Y, 009M, and 009C due to decrease of layer thickness of photoconductor; toner degradation of each color over time; change of charge amount of toner due to change of absolute humidity. In light of such situation, developing bias voltage of the development unit 012, 012Y, 012M, 012C, and laser power of the laser beams 014K, 014Y, 014M, 014C may need to be adjusted.

The concentration correction is conducted by adjusting image density (or concentration) of K, Y, M, and C to a target concentration set in advance. As shown in FIG. 1, sensors 0017, 018, and 019 may be disposed at a downstream of the image forming unit 006C while facing the intermediate transfer belt 005. The sensors 0017, 018, and 019 may be supported on a same board, and arranged in a direction perpendicular to a transport direction of the sheet 004 (i.e., arranged in a main scanning direction). The sensors 0017, 018, 019 may be also referred to toner mark (TM) sensors 0017, 018, and 019. An engine 050, used as a concentration correction unit, may use the TM sensors 0017, 018, and 019 for a concentration correction method to be described later. The engine 050 used for a concentration correction process may be configured with a central processing unit (CPU), which conducts a correction computing using software stored in a read only memory (ROM) and stores a correction result in a random access memory (RAM), for example.

Figure 3:
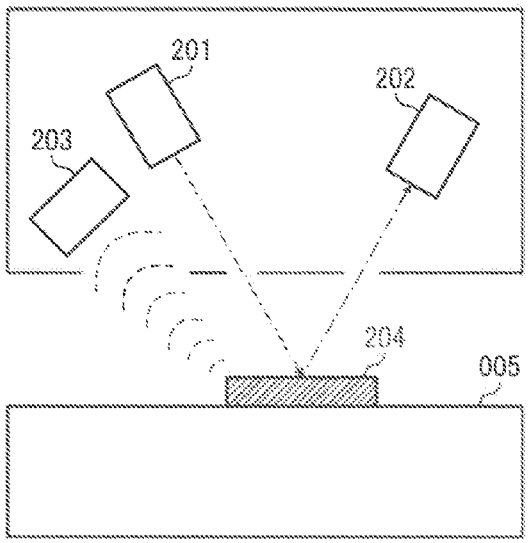
FIG. 3 shows a schematic configuration of a concentration sensor of image forming apparatus according to a first example embodiment.
Figure 4:
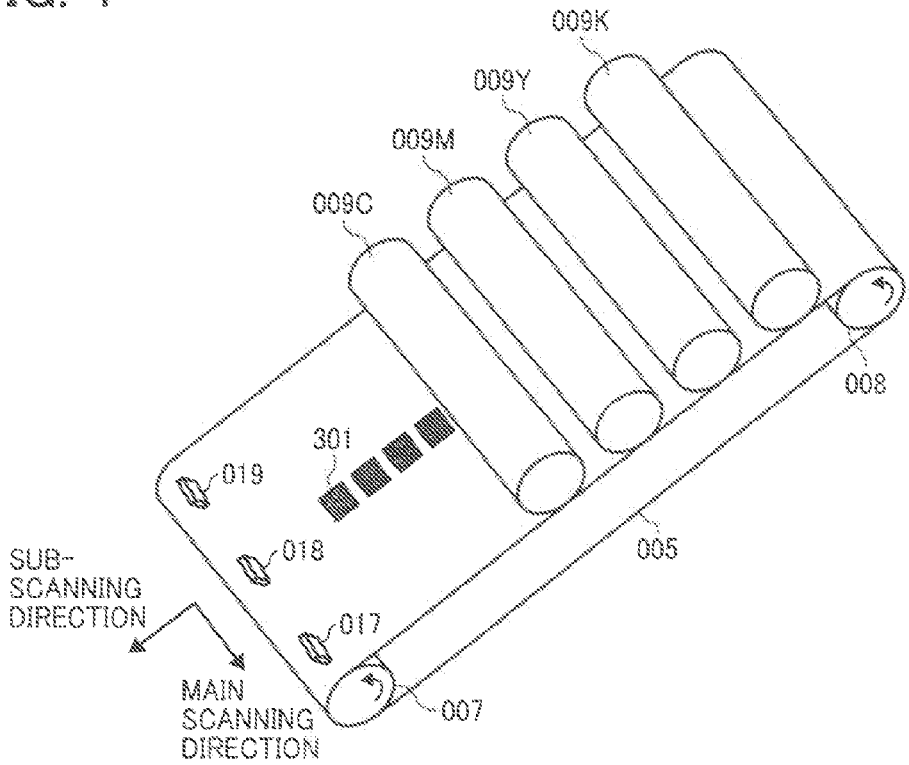
FIG. 4 shows a positional relationship of concentration correction pattern and a toner mark sensor according to a first example embodiment.

FIG. 3 shows an expanded view of the sensor 018, and FIG. 4 shows the sensors and other units around the sensors. The image forming apparatus may include the sensor 018 as first detector, and the sensors 0017 and 019 as second detector. The sensor 018, used as the first detector, may include a light emitting unit 201 (used as first light emitting device), a regular/diffuse reflection light receiving unit 202 (used as first mixed-light receiving device), a diffuse reflection light receiving unit 203 (used as first diffuse reflection light receiving device). Each of the sensors 0017, 019, used as the second detector, may include a light emitting unit 201 (used as second light emitting device), and a regular/diffuse reflection light receiving unit 202 (used as second mixed-light receiving device).

The light emitting unit 201 irradiates a light beam to concentration correction patches 204 formed on the intermediate transfer belt 005. The light receiving unit 202 receives a reflection light including a regular reflection light component and a diffuse reflection light component. Further, the receiving unit 203 receives a diffuse reflection light component. With such configuration, toner concentration of the concentration correction patches 204 can be detected by such image density detector (or image concentration detector). FIG. 4 shows one example concentration correction patterns for obtaining concentration for each color.

Figure 5:
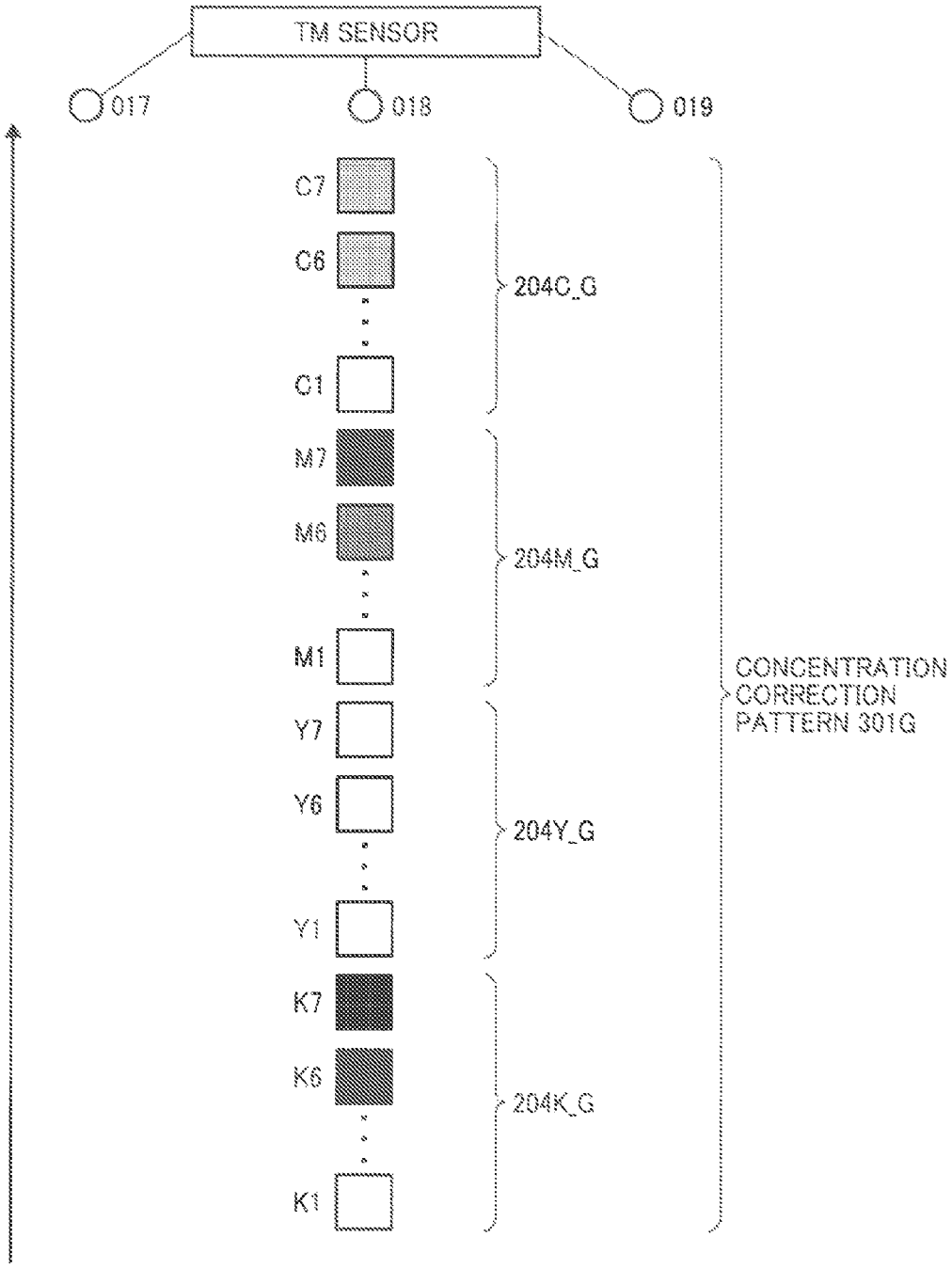
FIG. 5 shows concentration correction patches composing a conventional concentration correction pattern used for developing bias voltage adjustment.

FIG. 5 shows a concentration correction patch 204G composing a concentration correction pattern 301G used for adjusting developing bias voltage according to a conventional method or system. In the conventional method or system, the concentration correction pattern 301G may be composed of concentration correction patches 204C_G, 204M_G, 204Y_G, and 204K_G. For example, each color includes seven concentration correction patches, by which a total of twenty eight (28=4×7) of concentration correction patches are formed as the concentration correction patches 204C_G, 204M_G, 204Y_G, and 204K_G. And, as shown in FIG. 4, the concentration correction pattern 301G is formed at a position facing the sensor 018 having the diffuse reflection light receiving unit 203, by which concentration adjustment of each color is conducted. In the concentration correction pattern 301G of FIG. 5, each patch is attached with color code of CMYK for identifying color, and numbers for identifying the level of concentration in the concentration correction pattern 301G, wherein the lowest concentration is set with 1 and the highest concentration is set with 7. In FIG. 5, a center sensor corresponds to the sensor 018, for example.

Figure 6:
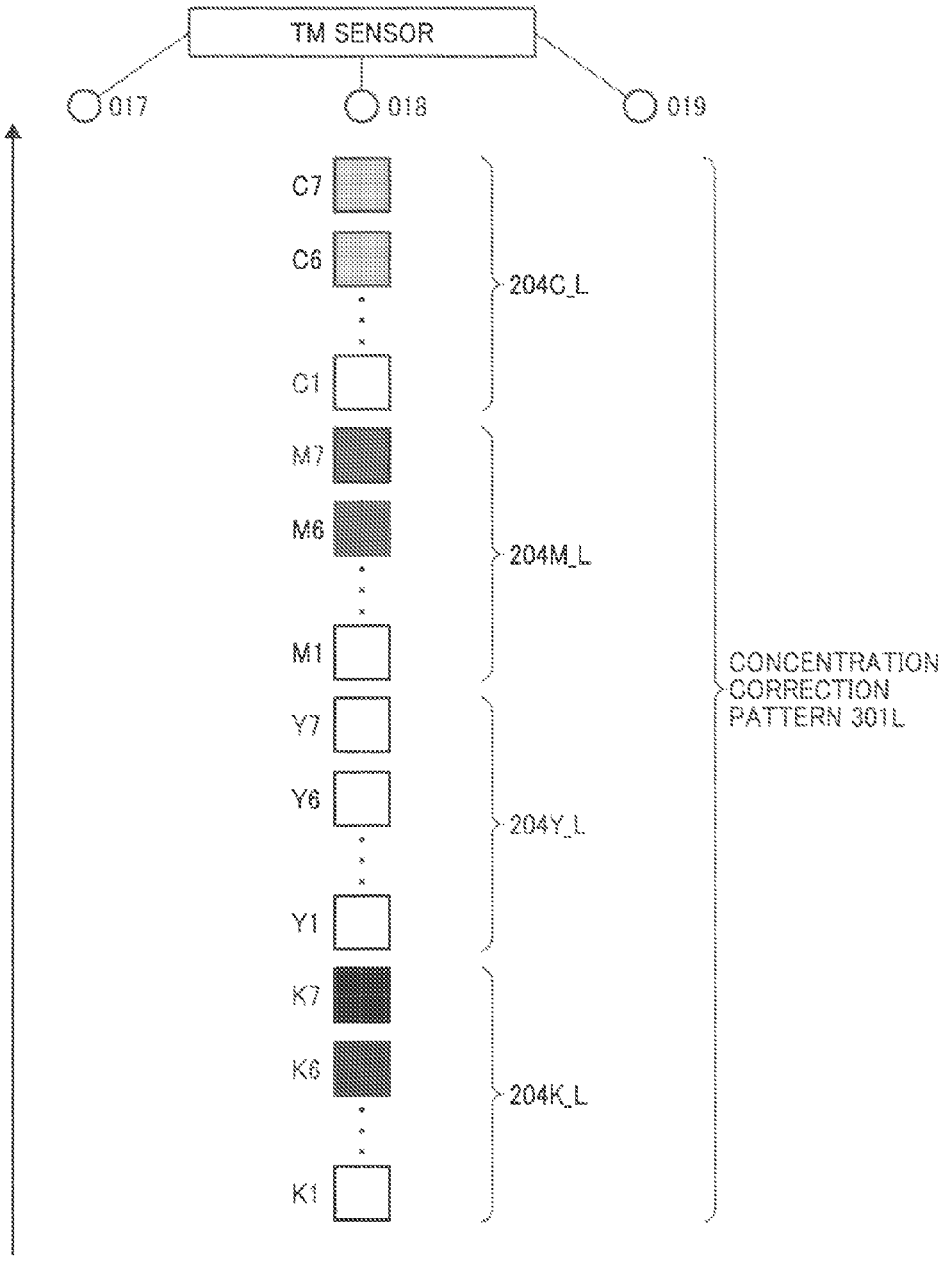
FIG. 6 shows concentration correction patches composing a conventional concentration correction pattern used for laser power adjustment.

FIG. 6 shows a concentration correction patches 204L composing a concentration correction pattern 301L used for adjusting laser power according to a conventional method or system. In the conventional method or system, the concentration correction pattern 301L is composed of concentration correction patches 204C_L, 204M_L, 204Y_L, and 204K_L as similar to the concentration correction pattern 301G. For example, each color includes seven concentration correction patches, by which a total of twenty eight (28=4×7) of concentration correction patches are formed as the concentration correction patches 204C_L, 204M_L, 204Y_L, and 204K_L. As similar to the concentration correction pattern 301G used for adjusting the developing bias voltage, the concentration correction pattern 301L is formed at a position facing the sensor 018 having the diffuse reflection light receiving unit 203, by which concentration adjustment of each color is conducted. In the concentration correction pattern 301L of FIG. 6, each patch is attached with color code of CMYK for identifying color, and numbers for identifying the level of concentration in the concentration correction pattern 301L, wherein the the lowest concentration is set with 1 and the highest concentration is set with 7. In FIG. 6, a center sensor corresponds to the sensor 018, for example.

Figure 7:
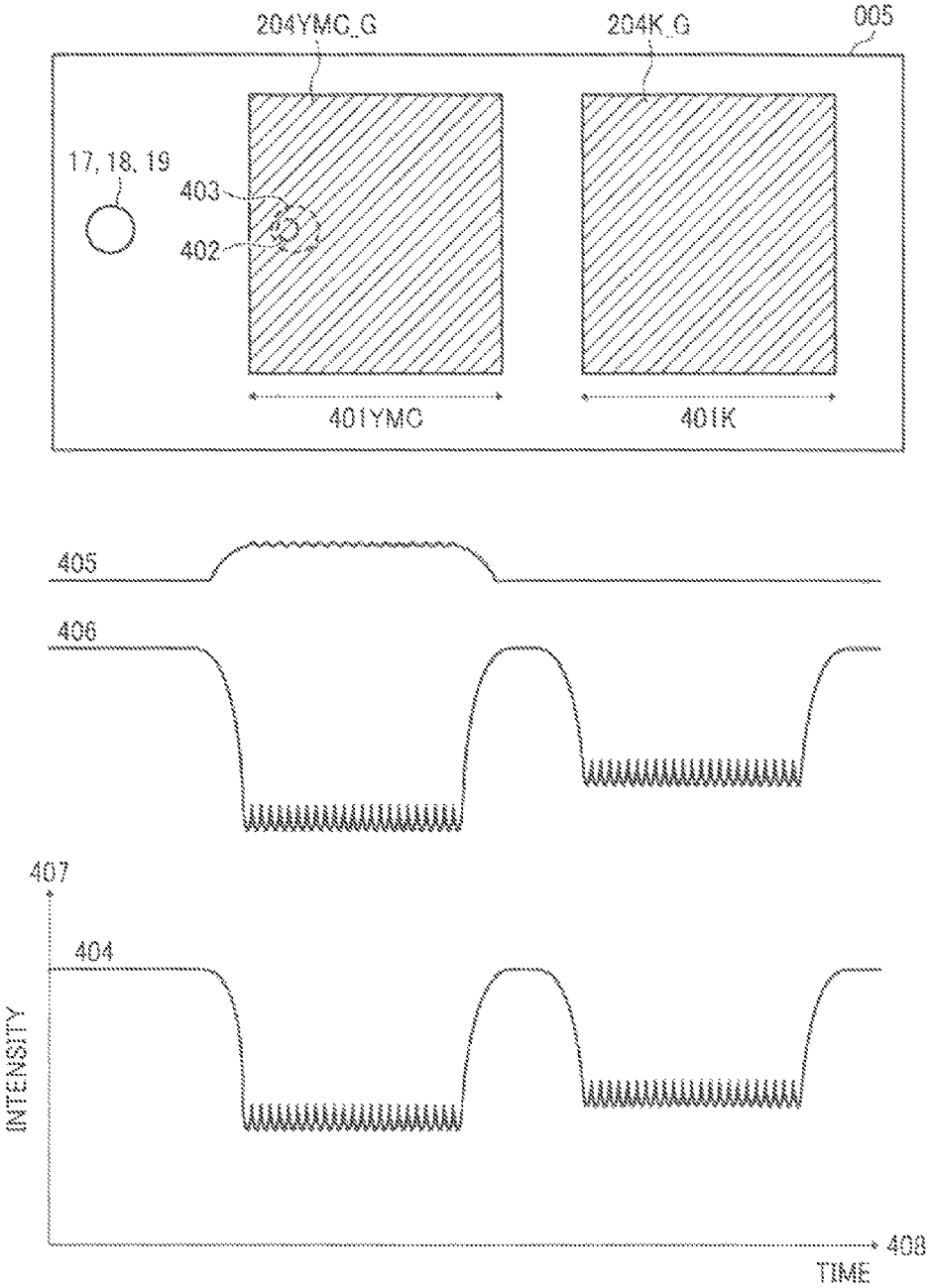
FIG. 7 shows a detection principle of concentration correction pattern.

FIG. 7 shows a detection principle of concentration correction pattern of FIGS. 5 and 6. The light emitting unit 201 irradiates a light beam. The light receiving unit 202 outputs an output signal corresponding to a reflection light from the intermediate transfer belt 005, which includes a regular reflection light component and a diffuse reflection light component. The output signal of the light receiving unit 202 is shown as an output signal 404. The vertical axis 407 indicates intensity of output signal of the light receiving unit 202, and the horizontal axis 408 indicates the time.

The signal of received light includes a diffuse reflection light component 405. The diffuse reflection light component 405 may not reflect from a surface of the intermediate transfer belt 005 and the patch 204K (black) so much, but may reflect from the patches 204Y, 204C, 204M. The signal of received light also includes a regular reflection light component 406. The regular reflection light component 406 reflects from the surface of the intermediate transfer belt 005 strongly, but the reflection amount (or intensity) of regular reflection light component 406 from the concentration correction patches 204 decreases for any one of colors.

The number of sampling points in each one patch of the concentration correction patches 204 is set to a given number that toner adhering amount can be computed correctly by averaging a plurality of detection results of at a plurality of sampling points of the regular reflection light component 406 and the diffuse reflection light component 405 in each one patch. When each one of concentration correction patches 204 are formed, a given amount of margin area is set for one end portion and another end portion in each one patch. Because an output value of regular reflection light component 406 and an output of diffuse reflection light component 405 of the concentration correction patches 204 may vary due to the change of image forming property and/or toner degradation, such varied output value is correlated with each of developing bias voltages and laser powers to conduct a concentration correction.

A margin area is set for one end portion and another end portion in each one patch in view of positional deviation of patch. Such margin area is set so that a regular reflection spot diameter 402 and a diffuse reflection spot diameter 403 (see FIG. 7) for detecting the regular reflection light component 406 and the diffuse reflection light component 405, respectively, may not come outside of the concentration correction patches 204. Because the position of patches may deviate for some length, if such margin area is not set for one patch, some of the sampling points (spotted as regular reflection spot diameter 402 and diffuse reflection spot diameter 403) may come outside of one patch, by which the detection result of concentration correction patches 204 may become incorrect.

A length of the concentration correction patches 204 in the sub-scanning direction is determined based on the number of sampling points, an interval of sampling points, and a margin. A length of the concentration correction patches 204 in a main scanning direction is determined based on a consideration of deviation of patch in a main scanning direction. Further, an arrangement interval of the concentration correction patches 204 is determined based on a consideration of switching time of the developing bias voltage and laser power.

The concentration correction may include two types of adjustment such as developing bias voltage adjustment and laser power adjustment. The developing bias voltage adjustment uses a solid patch, in which toner is adhered on all dots in the concentration correction patches 204, and concentration correction of the solid image is conducted. In the developing bias voltage adjustment, the developing bias voltage is changed to output a plurality of concentration correction patches 204 having different toner adhering amount, and based on image density (or concentration) of the concentration correction patches 204, a developing bias voltage value corresponding to a target concentration can be obtained. On one hand, the laser power adjustment uses a highlight patch, in which toner is adhered on one dot among four dots, which may be called as 1-on/3-off, and the concentration correction of highlight patch is conducted. In the laser power adjustment, the laser power is changed to output a plurality of concentration correction patches 204 having different toner adhering amount, and based on image density (or concentration) of the concentration correction patches 204, a laser power value corresponding to a target concentration can be obtained.

The concentration correction can be computed as follows. As for the concentration correction, the concentration correction patches 204 are irradiated with a light beam emitted from the light emitting unit 201, and an output voltage value, corresponding to the intensity of reflection light reflected from the concentration correction patches 204, is used.

However, the reflection light for CMY patches, reflected when light is irradiated on patches, may include a regular reflection light component and a diffuse reflection light component. The regular reflection light component is a light reflected from the intermediate transfer belt 005 with an angle same as an incident angle of incident light such as light beam. The diffuse reflection light component is a light reflected from the intermediate transfer belt 005 with various angles with respect to an incident angle of incident light. Accordingly, a correction value used for concentration correction can be obtained using the output voltage value of the light receiving unit, wherein the output voltage value is corresponded to the intensity of the regular reflection light component in the reflection light.

In cases of using CMY patterns, the output voltage value used for concentration correction is corresponded to a value, which is computed by subtracting the light intensity corresponding to diffuse reflection light from the total light intensity detected by the light receiving unit 202. Accordingly, in cases of using CMY patterns, beside the light receiving unit 202, the light receiving unit 203 for detecting only the diffuse reflection light is required. On one hand, in case of K pattern, the diffuse reflection light does not reflect from the K pattern, by which the light receiving unit 203 for detecting only the diffuse reflection light is not required for K pattern. Accordingly, in the image forming apparatus of the example embodiments, the concentration correction pattern for K is formed at dispersed positions or locations, corresponding to detection area of the TM sensors 107 and 109 which are not provided with the light receiving unit 203. On one hand, the concentration correction patterns for M, C, Y are formed at detection area of the TM sensor 108 provided with the light receiving unit 203.

The output voltage data obtained from the concentration correction patches 204 includes a mixed voltage data composed of regular and diffuse reflection voltage, and a diffuse reflection voltage. Because the concentration correction computation use only the regular reflection voltage, a diffuse reflection voltage value is removed from the mixed voltage data having the regular and diffuse reflection voltage. Based on the obtained regular reflection voltage value, an exposed rate for concentration correction patch is obtained and then the toner concentration is computed based on the exposed rate. Specifically, the exposed rate is obtained by dividing "area not covered by toner in one patch" by "one patch area," and such exposed rate indicates an exposed surface area of the intermediate transfer belt 005 in one patch, which is not covered by toner.

As for the developing bias voltage adjustment, a second order approximation is applied for toner concentration computed from the concentration correction patch 204G and the developing bias voltage value corresponding to patches, and then a developing bias voltage value corresponding to a target toner concentration is computed as a correction value. Further, as for the laser power correction, a first order approximation is applied for toner concentration computed from the concentration correction patch 204L and the laser power value corresponding to the patch, and then a laser power value corresponding to a target toner concentration is computed as a correction value.

After completing the concentration correction computation, the concentration correction patches 204 on the intermediate transfer belt 005 reaches the transfer roller 020, and then the toner may adhere on the transfer roller 020. The adhered toner can be removed by applying plus and minus bias alternately to the transfer roller 020, in which the toner can be scattered to the intermediate transfer belt 005 to clean the transfer roller 020. A cleaning time of the transfer roller 020 may be set in a ROM area in advance.

In a conventional case, for example, the twenty eight toner patches used as concentration correction pattern 301 shown in FIGS. 5 and 6 may adhere on a same position on the transfer roller 020, which is a same position in a main scanning position on the transfer roller 020. Accordingly, one given position on the transfer roller 020 has thickest toner concentration. Accordingly, the cleaning time of transfer roller 020 becomes longer in proportion to the toner concentration, by which a user downtime becomes longer.

On one hand, in example embodiment, the concentration correction pattern for K and the concentration correction patterns for M, C, Y are formed on the intermediate transfer belt 005 while dispersed in a main scanning direction (i.e., direction perpendicular to a sheet transport direction), by which the cleaning time of transfer roller 020 can be shortened, and a user downtime can be set shorter.

Figure 8:
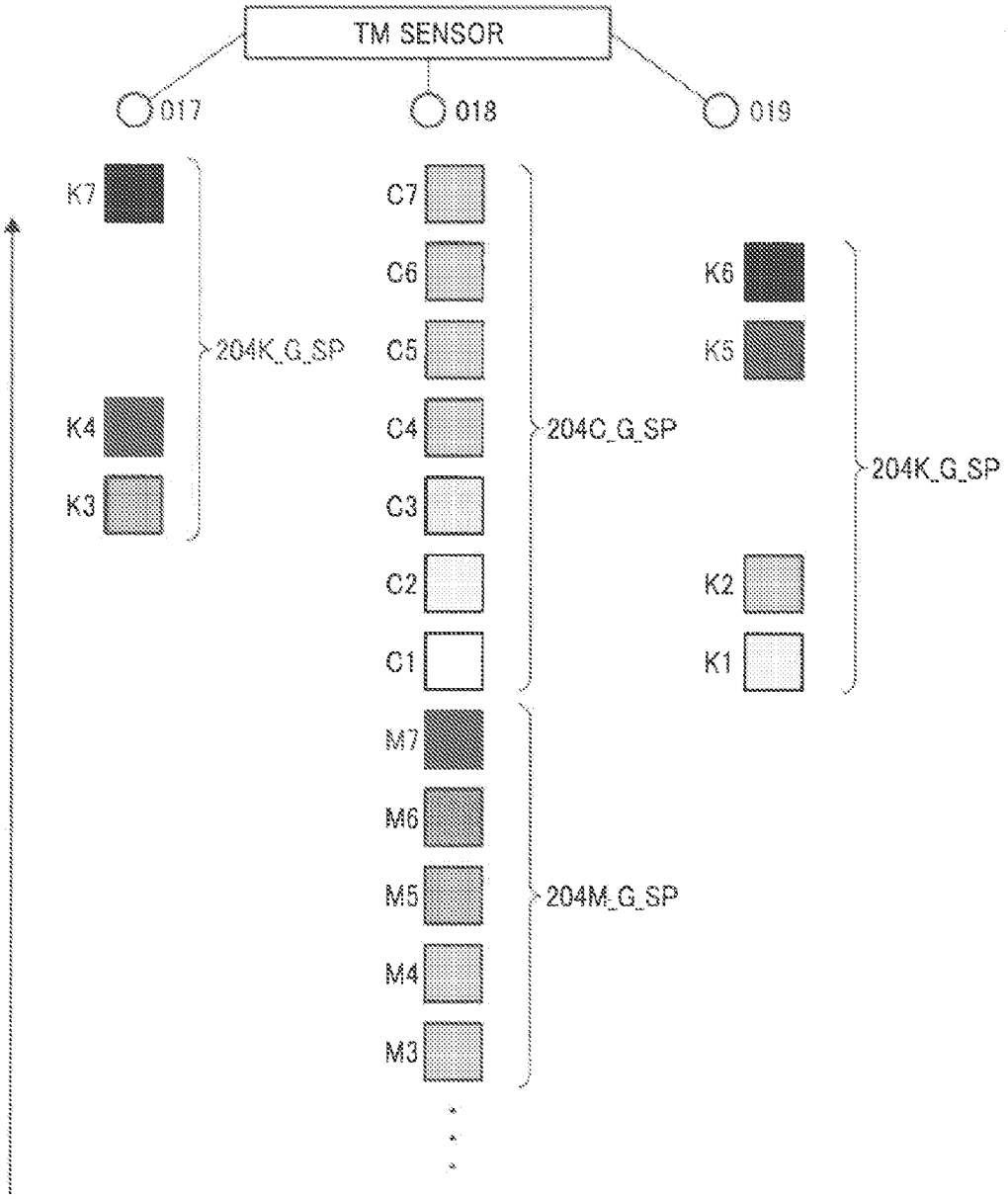
FIG. 8 shows concentration correction patches composing a concentration correction pattern according to a first example embodiment used for developing bias voltage adjustment.

FIG. 8 shows a concentration correction pattern used for adjusting developing bias voltage according to the first example embodiments. In the image forming apparatus, the concentration correction patches using toners other than black toner can be formed on the intermediate transfer belt 005 as the concentration correction patches 204YMC_G_SP as shown in FIG. 8, and the concentration correction patches 204YMC_G_SP are disposed at positions, which pass under the sensor 018 having the diffuse reflection light receiving unit 203. Then, the concentration correction patches using black toner can be formed on the intermediate transfer belt 005 as the concentration correction patches 204K_G_SP as shown in FIG. 8, and the concentration correction patches 204K_G_SP are disposed at positions, which pass under the sensor 0017 or the sensor 019 not having the diffuse reflection light receiving unit 203.

When the concentration correction patches 204K_G_SP for black (K) image are formed on the intermediate transfer belt 005 as shown in FIG. 8, each patch for K image is formed at at mutually exclusive positions in a sub-scanning direction on the intermediate transfer belt 005. Specifically, as shown in FIG. 8 for example, a plurality of black patches (concentration correction patches 204K_G_SP) are formed while different black patches are disposed at different positions in a sub-scanning direction position (or only one patch of K image exists on a same main scanning direction). Further, toner amount used for the concentration correction patches 204K_G_SP to be detected by the sensor 0017 and toner amount used for the concentration correction patches 204K_G_SP to be detected by the sensor 019 are set to substantially equal amount.

In the image forming apparatus according to example embodiments, the toner adhering amount becomes greater as the developing bias voltage becomes greater in minus side. In FIG. 8, a patch having the first largest developing bias voltage value, a patch having the fourth largest developing bias voltage value, and a patch having the fifth largest developing bias voltage value are disposed from near to far with respect to the sensor 017, and such patches pass under the sensor 0017. Then, a patch having the second largest developing bias voltage value, a patch having the third largest developing bias voltage value, a patch having the sixth largest developing bias voltage value, and a patch having the seventh largest developing bias voltage value are disposed from near to far with respect to the sensor 19, and such patches pass under the sensor 019. In such configuration, the first largest developing bias voltage value is a greatest voltage value, and the seventh largest developing bias voltage value is a smallest voltage value, for example.

Figure 9:
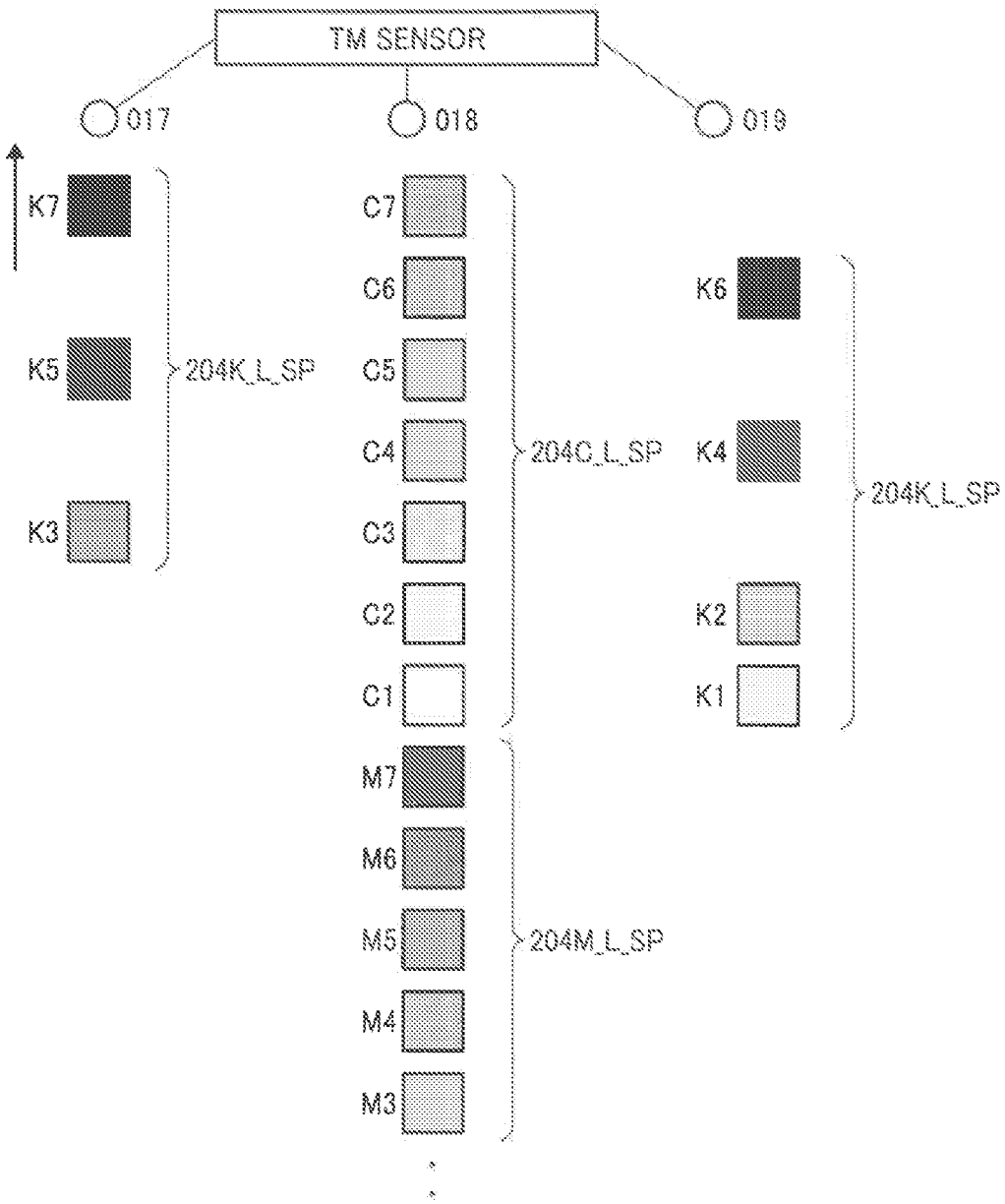
FIG. 9 shows concentration correction patches composing a concentration correction pattern according to a first example embodiment used for laser power adjustment.

FIG. 9 shows a concentration correction pattern used for adjusting laser power according to the first example embodiment. In the image forming apparatus, the concentration correction patches using toners other than black toner can be formed on the intermediate transfer belt 005 as the concentration correction patches 204YMC_L_SP as shown in FIG. 9, and the concentration correction patches 204YMC_L_SP are disposed at positions, which pass under the sensor 018 having the diffuse reflection light receiving unit 203. Then, the concentration correction patches using black toner can be formed on the intermediate transfer belt 005 as the concentration correction patches 204K_L_SP as shown in FIG. 9, and the concentration correction patches 204K_L_SP are disposed at positions, which pass under the sensor 0017 and the sensor 019 not having the diffuse reflection light receiving unit 203. In such configuration, the concentration correction patches 204K_L_SP (patches for black) and the correction patches 204C_L_SP (patches for cyan) may be aligned at a same position in a sub-scanning direction position, which means the front side of black patch and the front side of cyan patch may be aligned at a same position (see for example C6 and K6 in FIG. 9).

When the concentration correction patches 204K_L_SP for black (K) image are formed on the intermediate transfer belt 005 as shown in FIG. 9, each patch for K image is formed at at mutually exclusive positions in a sub-scanning direction on the intermediate transfer belt 005. Specifically, as shown in FIG. 9 for example, a plurality of black patches (concentration correction patches 204K_L_SP) are formed while different black patches are disposed at different positions in a sub-scanning direction position (or only one patch of K exists on a same main scanning direction). Further, toner amount used for the concentration correction patches 204K_L_SP to be detected by the sensor 0017 and toner amount used for the concentration correction patches 204K_LS_P to be detected by the sensor 019 are set to substantially equal amount.

In the image forming apparatus according to example embodiments, the toner adhering amount becomes greater as the laser power becomes greater in plus side. In FIG. 9, a patch having the first largest laser power value, a patch having the third largest laser power value, and a patch having the fifth largest laser power value are disposed from near to far with respect to the sensor 017, and such patches pass under the sensor 017. Then, a patch having the second largest laser power value, a patch having the fourth largest laser power value, a patch having the sixth largest laser power value, and a patch having the seventh largest laser power value are disposed from near to far with respect to the sensor 019, and such patches pass under the sensor 019. In such configuration, the first largest laser power value is a greatest voltage value, and the seventh largest laser power is a smallest voltage value, for example. As similar to conventional patches, as for the concentration correction patches 204 of FIGS. 8 and 9, a length of the concentration correction patches 204 in the sub-scanning direction is determined based on the number of sampling points, an interval of sampling points, and margin. A length of the concentration correction patches 204 in a main scanning direction is determined based on a consideration of deviation of patch in a main scanning direction. Further, an arrangement interval of the concentration correction patches 204 is determined based on a consideration of switching time of the developing bias voltage and laser power. Further, the detection method of 204KYMC_G_SP of FIG. 8 and the detection method of 204KYMC_L_SP of FIG. 9 are same as the detection method of FIG. 7.

Based on detection result of the concentration correction patches 204 shown in FIGS. 8 and 9, the concentration correction value can be computed. Specifically, based on a detection result of the concentration correction patches 204, an image density (or concentration) of the concentration correction patches 204 K, Y, C, M_G can be computed. A central processing unit (CPU) used as a concentration correction device unit conducts a given computing process to obtain a developing bias voltage value corresponding to a target concentration. Further, based on the image density (or concentration) of the concentration correction patches 204K, Y, C, M_L, the CPU conducts a given computing process to obtain a laser power value corresponding to a target concentration.

The concentration correction pattern 301 of FIGS. 8 and 9 used for concentration correction may adhere on the transfer roller 020 with a rotation movement of the intermediate transfer belt 005. In a conventional method or system, substantially all toner of the concentration correction patches 204 used for the developing bias voltage correction and laser power correction may adhere at one given portion of a transfer roller. On one hand, in example embodiment, the concentration correction patches 204 for developing bias voltage correction and for laser power correction are formed on the intermediate transfer belt 005 while dispersing the concentration correction patches 204. For example, positions of the concentration correction patches 204 of K color for developing bias voltage correction and for laser power correction are deviated from positions of the concentration correction patches 204 for YMC colors in a main scanning direction, in example cases shown in FIGS. 8 and 9, by which one fourth (¼) of the concentration correction patches 204 can be dispersed from other three fourth (¾) of concentration correction patches 204, and thereby a highest concentration of toner adhering at one given portion of the transfer roller becomes three fourth (¾) compared to a conventional method, by which the cleaning time of the transfer roller 020 can become three fourth (¾) compared to conventional method, and thereby the downtime of apparatus can be shortened.

Figures 10, 10A, 10B:
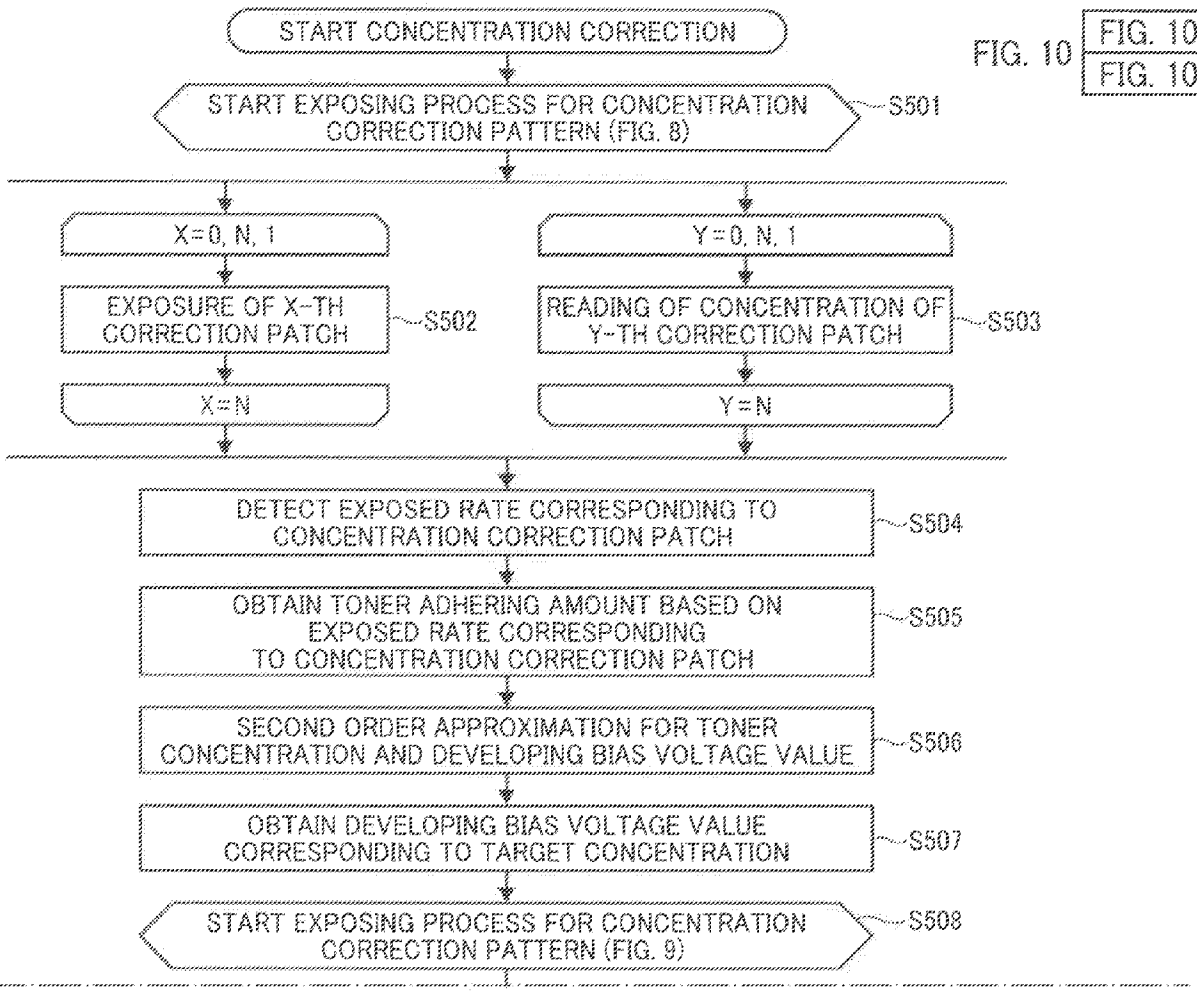
FIGS. 10A and 10B show a flow chart of process of computing concentration correction according to a first example embodiment.
Figure 10B:
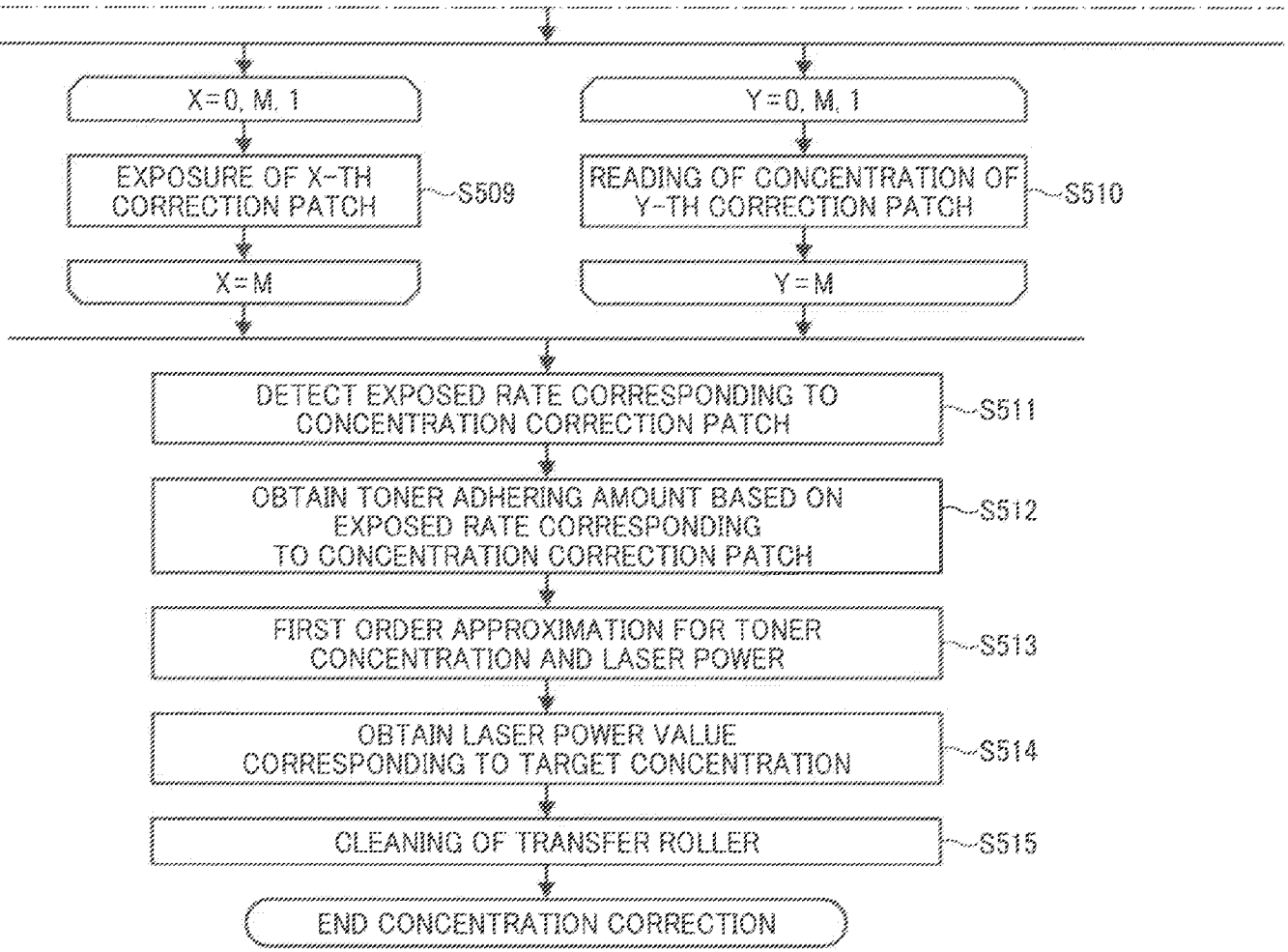

FIGS. 10A and 10B show a flowchart of a computing process of concentration correction. When the concentration correction starts, at step S501, an exposing process of the concentration correction pattern 301G (FIG. 8) to be used for developing bias voltage correction starts. At step S502, the exposing process of the concentration correction pattern 301G (FIG. 8) is conducted as required, and at step S503, the exposed concentration correction pattern 301G is developed and transferred, and then the TM sensor reads the concentration of the concentration correction pattern 301G when the concentration correction pattern 301G comes under the TM sensor, in which steps S502 and S503 are concurrently conducted. When steps S502 and S503 are conducted for a given number of times (N times: N is a whole number), at step S504, an exposed rate of each of concentration correction patches 204G is detected and obtained, wherein the exposed rate is obtained by dividing "area not covered by toner in one patch" by "one patch area," and such exposed rate indicates an exposed surface area of the intermediate transfer belt 005 in one patch, which is not covered by toner. Based on the exposed rate, toner adhering amount is obtained from a table, which stores data of exposed rate and data of toner adhering amount by corresponding exposed rate and toner adhering amount at step S505. At step S506, a second order approximation is applied to determine a relation of the obtained toner concentration of patch and developing bias voltage value, and then a developing bias voltage value corresponding to a target concentration is obtained at step S507. The correction of developing bias voltage ends here.

Then, at step S508, an exposing process of the concentration correction pattern 301L (FIG. 9) to be used for laser power correction starts. At step S509, the exposing process of the concentration correction pattern 301L (FIG. 9) is conducted as required, and at step S510, the exposed concentration correction pattern 301L is developed and transferred, and then the TM sensor reads the concentration of the concentration correction pattern 301L when the concentration correction pattern 301L comes under the TM sensor, in which steps S509 and S510 are concurrently conducted. When steps S509 and S510 are conducted for a given number of times (M times: M is a whole number), at step S511, an exposed rate of each of concentration correction patches 204L is detected and obtained, wherein the exposed rate is obtained by dividing "area not covered by toner in one patch" by "one patch area," and such exposed rate indicates an exposed surface area of the intermediate transfer belt 005 in one patch, which is not covered by toner. Based on the exposed rate, toner adhering amount is obtained from a table, which stores data of exposed rate and data of toner adhering amount by corresponding exposed rate and toner adhering amount at step S512. At step S513, a first order approximation is applied to determine a relation of the obtained toner concentration of patch and laser power value, and then a laser power value corresponding to a target concentration is obtained at step S514. The correction of laser power ends here. Then, the transfer roller 020 adhered with the concentration correction pattern 301 of FIGS. 8 and 9 is cleaned at step S515, by which the process ends.

Second Example Embodiment

A description is now given to a second example embodiment, in which the concentration correction is conducted using only black when any one of yellow, magenta, and cyan toner, or a plurality of such color toners is at a toner end condition, wherein toner may be substantially consumed at the toner end condition and not usable. In the second example embodiment, a concentration correction pattern formed on the intermediate transfer belt 005 is different from the first example embodiment as described later in detail. Other than concentration correction pattern, same configuration of the first example embodiment is used for the image forming apparatus and image density detector (or image concentration detector), the concentration correction method, or the like.

Figure 11:
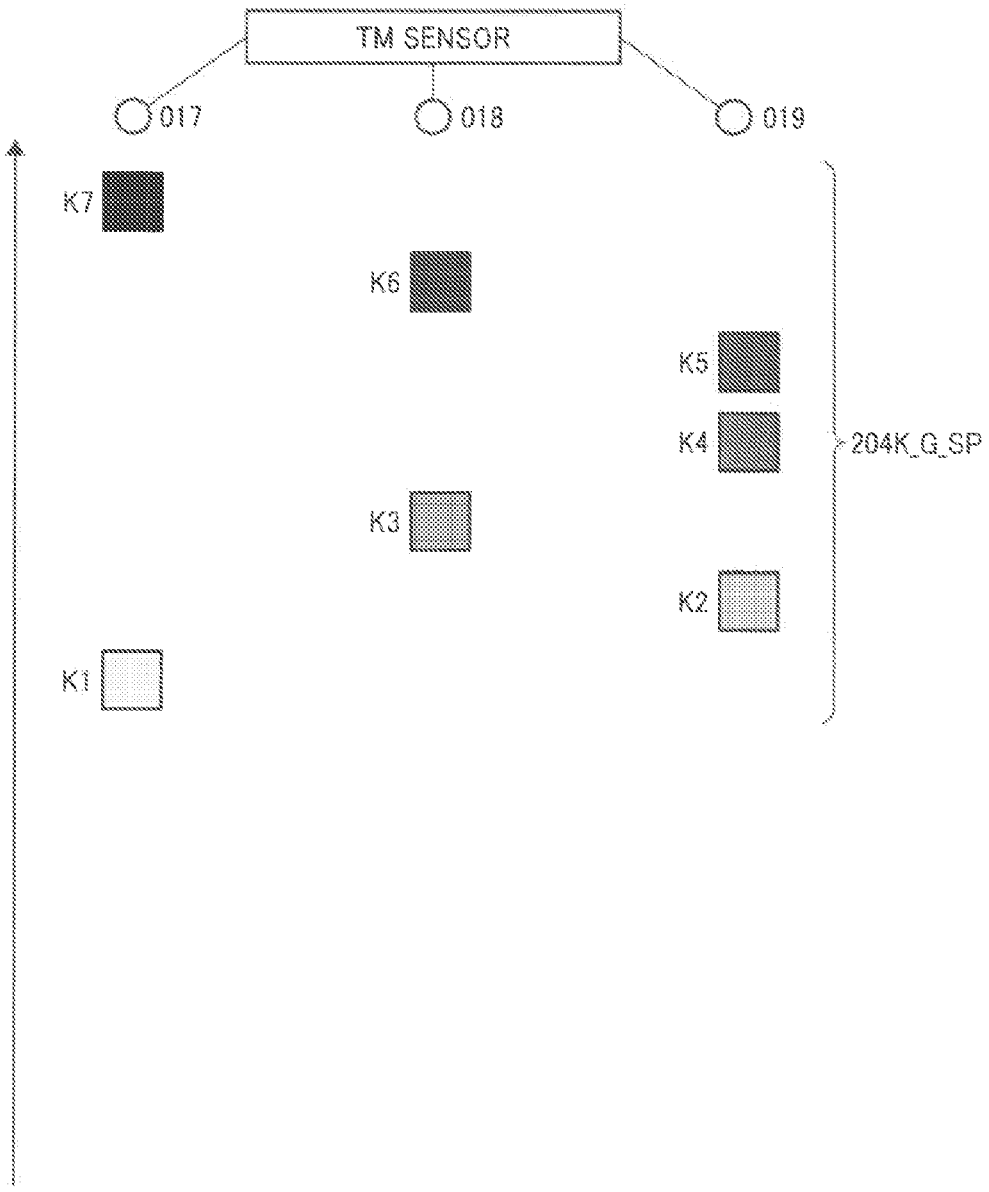
FIG. 11 shows concentration correction patches composing a conventional concentration correction pattern according to a second example embodiment used for developing bias voltage adjustment.

FIG. 11 shows a concentration correction pattern used for adjusting developing bias voltage according to the second example embodiment, which is formed on the intermediate transfer belt 005 of the image forming apparatus. In the image forming apparatus, the concentration correction patches using black toner can be formed on the intermediate transfer belt 005 as the concentration correction patches 204K_G_SP, and the concentration correction patches 204K_G_SP are dispersed at different positions, wherein such patches pass under the sensors 0017, 018, 019. When the concentration correction patches 204K_G_SP for black (K) image are formed on the intermediate transfer belt 005 as shown in FIG. 11, each patch for K image is formed at at mutually exclusive positions in a sub-scanning direction on the intermediate transfer belt 005. Specifically, as shown in FIG. 11 for example, a plurality of black patches (concentration correction patches 204K_G_SP) are formed while different black patches are disposed at different positions in a sub-scanning direction position (or only one patch of K exists in a main scanning direction). Further, toner amount used for the concentration correction patches 204K_G_SP to be detected by the sensor 0017, toner amount used for the concentration correction patches 204K_G_SP to be detected by the sensor 018, and toner amount used for the concentration correction patches 204K_G_SP to be detected by the sensor 019 are set to substantially equal amount.

Figure 12:
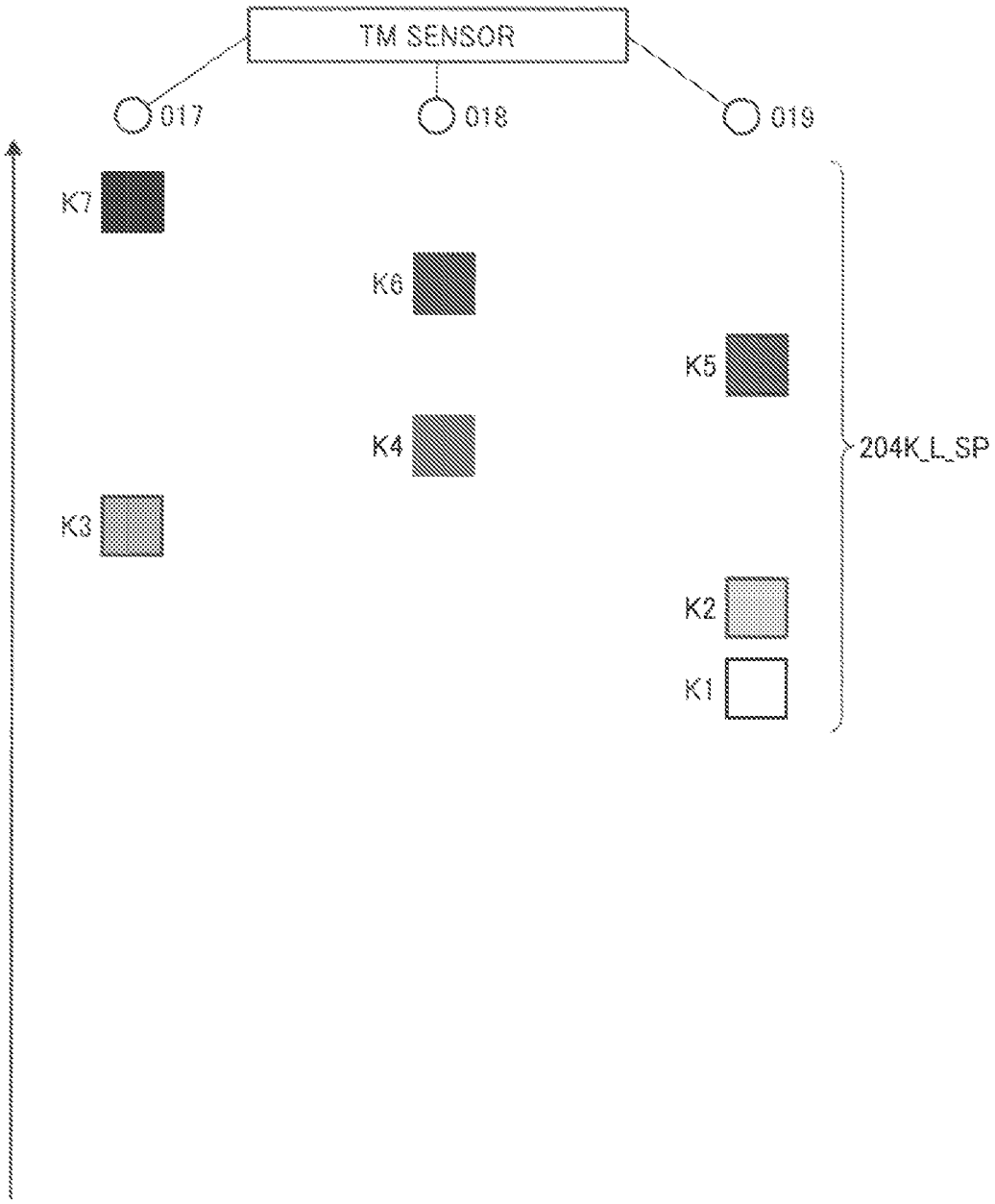
FIG. 12 shows concentration correction patches composing a concentration correction pattern according to a second example embodiment used for laser power adjustment.

In the image forming apparatus according to the second example embodiment, the toner adhering amount becomes greater as the developing bias voltage becomes greater in minus side. In FIG. 11, a patch having the first largest developing bias voltage value, and a patch having the seventh largest developing bias voltage value are disposed from near to far with respect to the sensor 017, and such patches pass under the sensor 017. Then, a patch having the second largest developing bias voltage value, and a patch having the fifth largest developing bias voltage value are disposed from near to far with respect to the sensor 18, and such patches pass under the sensor 018. Then, a patch having the third largest developing bias voltage value, a patch having the fourth largest developing bias voltage value, and a patch having the sixth largest developing bias voltage value are disposed from near to far with respect to the sensor 19, and such patches pass under the sensor 019. In such configuration, the first largest developing bias voltage value is a greatest voltage value, and the seventh largest developing bias voltage value is a smallest voltage value, for example. FIG. 12 shows a concentration correction pattern used for adjusting laser power according to the second example embodiment, which is formed on the intermediate transfer belt 005 of the image forming apparatus. In the image forming apparatus, the concentration correction patches using black toner can be formed on the intermediate transfer belt 005 as the concentration correction patches 204K_L_SP as shown in FIG. 12, and the concentration correction patches 204K_L_SP are disposed at positions, which pass under the sensors 0017, 018, and 019. When the concentration correction patches 204K_L_SP for black (K) image are formed on the intermediate transfer belt 005 as shown in FIG. 12, each patch for K image is formed at mutually exclusive positions in a sub-scanning direction on the intermediate transfer belt 005. Specifically, as shown in FIG. 12 for example, a plurality of black patches (concentration correction patches 204K_L_SP) are formed while different black patches are disposed at different positions in a sub-scanning direction position (or only one patch of K exists in a main scanning direction). Further, toner amount used for the concentration correction patches 204K_L_SP to be detected by the sensor 0017, toner amount used for the concentration correction patches 204K_L_SP to be detected by the sensor 018, and toner amount used for the concentration correction patches 204K_L_SP to be detected by the sensor 019 are set to substantially equal amount. In the image forming apparatus according to the second example embodiment, the toner adhering amount becomes greater as the laser power becomes greater in plus side. In FIG. 12, a patch having the first largest laser power value, and a patch having the fifth largest laser power value are disposed from near to far with respect to the sensor 0017, and such patches pass under the sensor 017. Then, a patch having the second largest laser power value, and a patch having the fourth largest laser power value are disposed from near to far with respect to the sensor 018, and such patches pass under the sensor 018. Then, a patch having the third largest laser power value, a patch having the sixth largest laser power value, and a patch having the seventh largest laser power value are disposed from near to far with respect to the sensor 019, and such patches pass under the sensor 019. In such configuration, the first largest laser power value is a greatest voltage value, and the seventh largest laser power is a smallest voltage value, for example.

As similar to conventional patches, as for the concentration correction patches 204 of FIGS. 11 and 12, a length of the concentration correction patches 204 in the sub-scanning direction is determined based on the number of sampling points, an interval of sampling points, and margin. A length of the concentration correction patches 204 in a main scanning direction is determined based on a consideration of deviation of patch in a main scanning direction. Further, an arrangement interval of the concentration correction patches 204 is determined based on a consideration of switching time of the developing bias voltage and laser power. Further, the detection method of 204K_G_SP of FIG. 11 and the detection method of 204K_L_SP of FIG. 12 are same as the detection method of FIG. 7.

Based on detection result of the concentration correction patches 204 shown in FIGS. 11 and 12, the concentration correction value can be computed. Specifically, based on a detection result of the concentration correction patches 204, an image density (or concentration) of the concentration correction patches 204K_G can be computed. A central processing unit (CPU) used as a concentration correction device conducts a given computing process to obtain a developing bias voltage value corresponding to a target concentration. Further, based on the image density (or concentration) of the concentration correction patches 204K_L, the CPU conducts a given computing process to obtain a laser power value corresponding to a target concentration.

The concentration correction pattern 301 of FIGS. 11 and 12 used for concentration correction may adhere on the transfer roller 020 with a rotation movement of the intermediate transfer belt 005. In a conventional method or system, substantially all toner of the concentration correction patches 204 used for the developing bias voltage correction and laser power correction adhere at one given portion of a transfer roller. On one hand, in the second example embodiment, the concentration correction patches 204 for developing bias voltage correction and for laser power correction are formed on the intermediate transfer belt 005 while dispersing the concentration correction patches 204. For example, each position of the concentration correction patches 204 of K color for developing bias voltage correction and for laser power correction is mutually exclusive each other in a sub-scanning direction. In a case of FIG. 12, three lines of concentration correction patches are formed in line with each of the TM sensors, and toner concentration of each line may be one third of total toner concentration of three lines, by which two thirds (⅔) of the concentration correction patches 204 for developing bias voltage correction and for laser power correction is dispersed, by which toner concentration adhering at one given portion of the transfer roller becomes one third (⅓) compared to conventional method, by which the cleaning time of the transfer roller 020 becomes one third (⅓) compared to a conventional method, and thereby the downtime of apparatus can be shortened.

In the above described first and second example embodiments, an image forming apparatus employing an intermediate transfer system is explained, but the image forming apparatus is not limited thereto. For example, the above described correction can be applied to an image forming apparatus employing a direct transfer system. In the image forming apparatus employing the direct transfer system, image forming units may be arranged side by side, and a transport belt used as a transport member to transport a sheet may be used instead of the above described intermediate transfer belt for conducting the above described correction process. The image forming apparatus may be a printer, a copier, multifunctional peripherals (MFP), a facsimile machine, or the like.

In the above-described exemplary embodiments, a computer can be used with a computer-readable program to control functional units used for an image forming system or apparatus. For example, a particular computer may control the image forming apparatus using a computer-readable program, which can execute the above-described processes or steps. Further, in the above-described exemplary embodiments, a storage device (or recording medium), which can store computer-readable program, may be a flexible disk, a CD-ROM (compact disk read only memory), DVD (digital versatile disk), a memory card, a memory chip, or the like, but not limited these. Further, a computer-readable program can be downloaded to a particular computer (e.g., personal computer) via a network, or a computer-readable program can be installed to a particular computer from the above-mentioned storage device, by which the particular computer may be used for the forming system or apparatus according to exemplary embodiments, for example.

In a conventional concentration correction method, concentration correction patches for each color are formed on an intermediate transfer belt by changing values of developing bias voltage and/or laser power, and then regular reflection light and diffuse reflection light from the patches are measured. Based on the measured result, a developing bias voltage value and a laser power value is computed and used for concentration correction to set a target concentration. In the present invention, concentration correction patterns are arranged in a given manner to shorten a cleaning time of a transfer roller as above described.

The concentration correction may need two types of light such as regular reflection light and diffuse reflection light. In case of black (K) color, diffuse reflection light does not reflect from the concentration correction pattern of K to a toner mark (TM) sensor, by which a correction amount for black can be computed without diffuse reflection light. Accordingly, the concentration correction for black can be conducted by disposing the concentration correction patches for K under a TM sensor that can measure only regular reflection light, and further the concentration correction patch for K can be disposed at dispersed positions corresponding to a plurality of TM sensors.

As such, the concentration correction patterns can be disposed at dispersed positions corresponding to a plurality of TM sensors. With such a configuration, too much adherence of toner onto one given portion of transfer roller can be prevented, and the cleaning time of transfer roller, which is determined based on a highest toner concentration on the transfer rollers can be reduced or shortened.

As above described, in then image forming apparatus according to example embodiments, a cleaning time related to cleaning condition of the concentration correction patterns can be reduced or shorten, by which a downtime of apparatus can be reduced.

As above described, concentration correction patterns are concentrated on one given portion on a transport member in conventional apparatuses, but in the image forming apparatus according to example embodiments, concentration correction patterns can be transferred to different positions on a transport member, by which toner adhesion on a transport member can be dispersed, and thereby a downtime of apparatus can be reduced.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

an image forming unit to develop an electrostatic latent image on an image bearing member as a toner image and to transfer the toner image onto a transport member;

a first detector including a first light emitting device, a first mixed-light receiving device, and a first diffuse reflection light receiving device, the first mixed-light receiving device detecting a mixed light including regular reflection light and diffuse reflection light, the regular reflection light composed of a regular reflection light component reflected from the transport member when the first light emitting device irradiates the transport member with light, the diffuse reflection light composed of a diffuse reflection light component reflected from the transport member when the first light emitting device irradiates the transport member with light, the first diffuse reflection light receiving device detecting the diffuse reflection light;

a second detector including a second light emitting device and a second mixed-light receiving device for detecting the mixed light; and a concentration correction unit to conduct concentration correction using detection results of the first detector and the second detector, wherein the first detector and the second detector are arranged side by side in a main scanning direction of the transport member, the image forming unit develops a first correction pattern using a first color toner that reflects the regular and diffuse reflection light, and transfers the first correction pattern as a concentration correction pattern used for concentration correction by the concentration correction unit at a position on the transport member detectable by the first detector, while the image forming unit develops a second correction pattern using a second color toner that reflects only the regular reflection light, and transfers the second correction pattern as a concentration correction pattern used for concentration correction by the concentration correction unit at a position on the transport member detectable by the second detector.

2. The image forming apparatus of claim 1, comprising two or more second detectors, wherein a toner amount of the second correction pattern transferred to one position on the transport member detectable by one second detector and a toner amount of the second correction pattern transferred to another position on the transport member detectable by another second detector are substantially equal.

3. The image forming apparatus of claim 1, wherein, when only the second color toner is in a toner usable condition, the image forming unit forms the second correction pattern as the concentration correction pattern at positions on the transport member detectable by both the first detector and the second detector.

4. The image forming apparatus of claim 3, wherein a toner amount of the second correction pattern transferred to one position on the transport member detectable by the first detector and a toner amount of the second correction pattern transferred to another position on the transport member detectable by the second detector are substantially equal.

5. The image forming apparatus of claim 1, wherein the second correction pattern formed on the transport member includes a plurality of patches disposed at mutually exclusive positions in a sub-scanning direction.

6. The image forming apparatus of claim 1, wherein the first color is cyan, magenta, or yellow, and the second color is black.

7. A concentration correction method for an image forming apparatus, the image forming apparatus including:

an image forming unit to develop an electrostatic latent image on an image bearing member as a toner image and to transfer the toner image onto a transport member;

a first detector including a first light emitting device, a first mixed-light receiving device, and a first diffuse reflection light receiving device, the first mixed-light receiving device detecting a mixed light including regular reflection light and diffuse reflection light, the regular reflection light composed of a regular reflection light component reflected from the transport member when the first light emitting device irradiates the transport member with light, the diffuse reflection light composed of a diffuse reflection light component reflected from the transport member when the first light emitting device irradiates the transport member with light, the first diffuse reflection light receiving device detecting the diffuse reflection light;

a second detector including a second light emitting device and a second mixed-light receiving device for detecting the mixed light, the method comprising the steps of:

transferring a first correction pattern, used as a concentration correction pattern for concentration correction, developed by a first color toner that reflects the regular and diffuse reflection light at a position on the transport member detectable by the first detector;

transferring a second correction pattern used as a concentration correction pattern for concentration correction, developed by a second color toner that reflects only the regular reflection light at another position on the transport member detectable by the second detector arranged side by side with the first detector in a main scanning direction of the transport member;

computing toner concentration of an image formed on the transport member based on detection results of the first detector and the second detector; and correcting the toner concentration of the image based on the computed toner concentration.

* * * * *